US011791592B2

(12) United States Patent
Hung

(10) Patent No.: US 11,791,592 B2
(45) Date of Patent: Oct. 17, 2023

(54) ELECTRICAL CONNECTOR

(71) Applicant: Dongguan Luxshare Technologies Co., Ltd, Dongguan (CN)

(72) Inventor: Yung-Chih Hung, Taipei (TW)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 311 days.

(21) Appl. No.: 17/307,328

(22) Filed: May 4, 2021

(65) Prior Publication Data

US 2021/0408734 A1 Dec. 30, 2021

(30) Foreign Application Priority Data

Jun. 24, 2020 (CN) ..... 202010587690.0

(51) Int. Cl.
*H01R 13/648* (2006.01)
*H01R 13/6585* (2011.01)
(Continued)

(52) U.S. Cl.
CPC ..... *H01R 13/6585* (2013.01); *H01R 12/585* (2013.01); *H01R 12/727* (2013.01); *H01R 13/502* (2013.01); *H01R 13/6594* (2013.01)

(58) Field of Classification Search
CPC ..... H01R 13/6585; H01R 13/6586; H01R 13/6587; H01R 13/6594; H01R 13/502; H01R 12/585; H01R 12/727
(Continued)

(56) References Cited

U.S. PATENT DOCUMENTS 6,095,826 A 8/2000 Potters
11,456,547 B2 9/2022 Su et al.
(Continued)

FOREIGN PATENT DOCUMENTS

CN 2884584 Y 3/2007
CN 202196931 U 4/2012
(Continued)

OTHER PUBLICATIONS

Chinese Office Action for application No. 202010587690.0 dated Feb. 19, 2021.

*Primary Examiner* — Khiem M Nguyen
(74) *Attorney, Agent, or Firm* — Birch, Stewart, Kolasch & Birch, LLP

(57) ABSTRACT

The present disclosure provides an electrical connector comprising a connector body, a plurality of signal terminals, and a cover. The connector body comprises a plugging slot, a cover accommodating notch, and a plurality of signal terminal slots. The plurality of the signal terminal slots is disposed between the plugging slot and the cover accommodating notch. The cover accommodating notch communicates with the plugging slot through the plurality of signal terminal slots. The cover accommodating notch comprises two opposite sidewalls. An abutting member is disposed on one side of the sidewall. A limiting block is disposed at one end of each of the sidewalls away from an end surface of the cover accommodating notch. The plurality of signal terminals are respectively disposed in the corresponding signal terminal slots. The cover is disposed in the cover accommodating notch and covers the plurality of the signal terminals.

17 Claims, 12 Drawing Sheets

(51) Int. Cl.

| | |
|---|---|
| ***H01R 12/58*** | (2011.01) |
| ***H01R 12/72*** | (2011.01) |
| ***H01R 13/502*** | (2006.01) |
| ***H01R 13/6594*** | (2011.01) |

(58) Field of Classification Search
USPC ..... 439/607.05
See application file for complete search history.

(56) References Cited

U.S. PATENT DOCUMENTS

| | | | | |
|---|---|---|---|---|
| 11,621,507 | B2 * | 4/2023 | Hung | H01R 13/41 439/630 |
| 2005/0277312 | A1 | 12/2005 | Nakamura | |
| 2009/0221190 | A1 | 9/2009 | Ambo et al. | |
| 2013/0109224 | A1 | 5/2013 | Chin et al. | |
| 2019/0067880 | A1 | 2/2019 | Zhang et al. | |
| 2021/0408734 | A1 | 12/2021 | Hung | |
| 2021/0408752 | A1 * | 12/2021 | Hung | H01R 43/16 |

FOREIGN PATENT DOCUMENTS

| | | | |
|---|---|---|---|
| CN | 206461121 | U | 9/2017 |
| CN | 107528162 | A | 12/2017 |
| CN | 209981515 | U | 1/2020 |
| JP | 9-330758 | A | 12/1997 |
| TW | M379241 | U1 | 4/2010 |
| TW | M506398 | U | 8/2015 |

* cited by examiner

ELECTRICAL CONNECTOR

CROSS-REFERENCE TO RELATED APPLICATION

This application claims the priority benefit of Chinese Patent Application Serial Number 202010587690.0, filed on Jun. 24, 2020, the full disclosure of which is incorporated herein by reference.

BACKGROUND

Technical Field

The present disclosure relates to the technical field of connector, particularly to an electrical connector.

Related Art

Conventional connectors (such as power connectors or low-speed connectors) usually include a connector body, a plurality of signal terminals, a plurality of power terminals, and a cover. The plurality of signal terminals are fixed onto the connector body by the cover. However, the cover is prone to detach from the connector body when the connector is in use.

SUMMARY

The embodiments of the present disclosure provide an electrical connector tended to solve the problem that the cover which fixes the signal terminal in the connector is prone to detach.

The present disclosure provides an electrical connector, comprising a connector body, a plurality of signal terminals, and a cover. The connector body comprises a plugging slot, a cover accommodating notch, and a plurality of signal terminal slots. The plurality of the signal terminal slots is disposed between the plugging slot and the cover accommodating notch. The cover accommodating notch communicates with the plugging slot through the plurality of signal terminal slots. The cover accommodating notch comprises two opposite sidewalls. An abutting member is disposed on one side of the sidewall. A limiting block is disposed at one end of each of the sidewalls away from an end surface of the cover accommodating notch. The plurality of signal terminals are respectively disposed in the corresponding signal terminal slots. The cover is disposed in the cover accommodating notch and covers the plurality of the signal terminals. The two abutting members support the cover. The two limiting blocks restrict the cover to allow the cover to move in a direction perpendicular to the end surface of the cover accommodating notch.

In the embodiments of the present disclosure, the cover is fixed in the cover accommodating notch through the abutting member and the limiting block disposed in the cover body accommodating notch to prevent the cover from detaching from the cover accommodating notch when the electrical connector is in use. Thus, the cover could cover a plurality of signal terminals stably to avoid exposure of the signal terminals.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
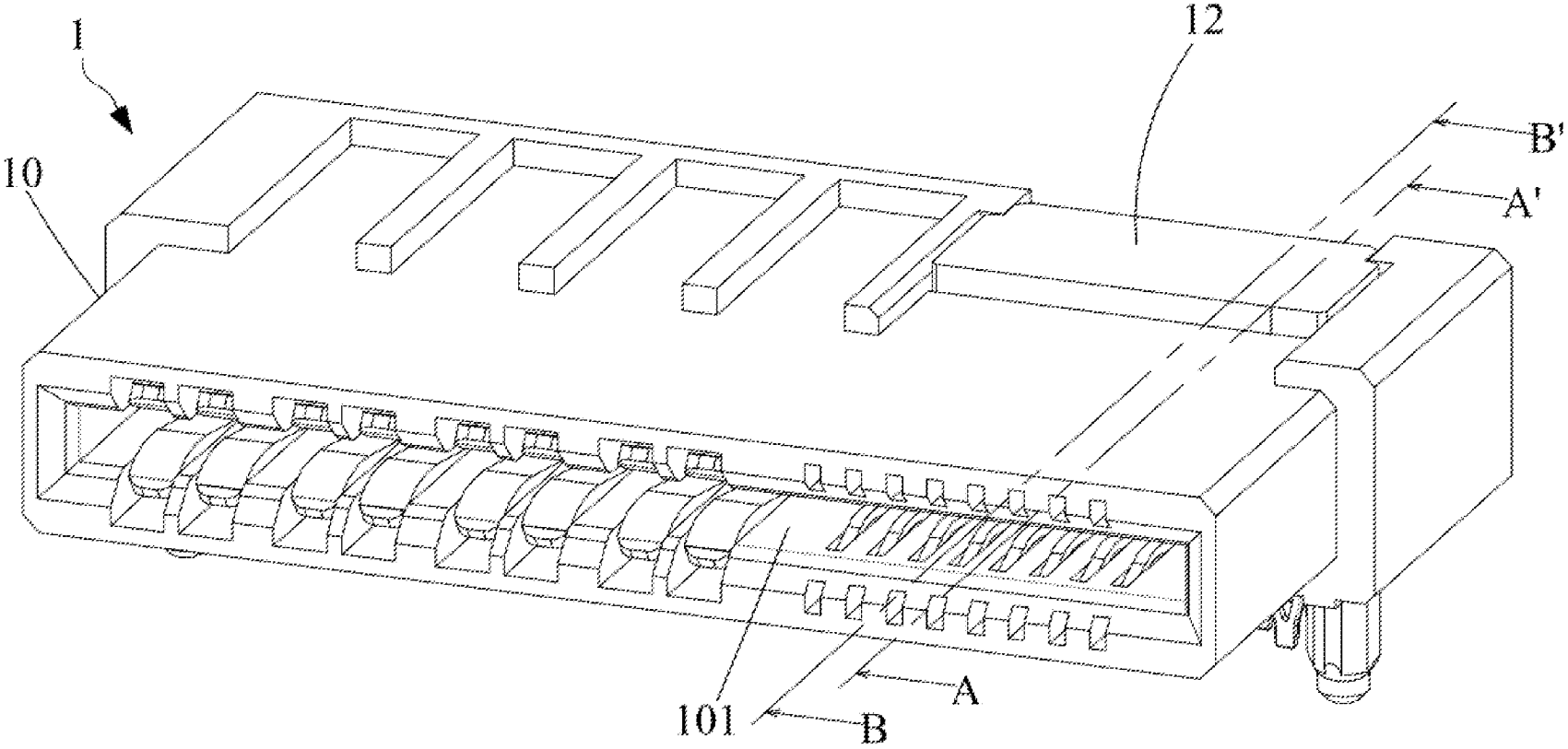
FIG. 1 is a perspective view of an electrical connector of an embodiment of the present disclosure.
Figure 2:
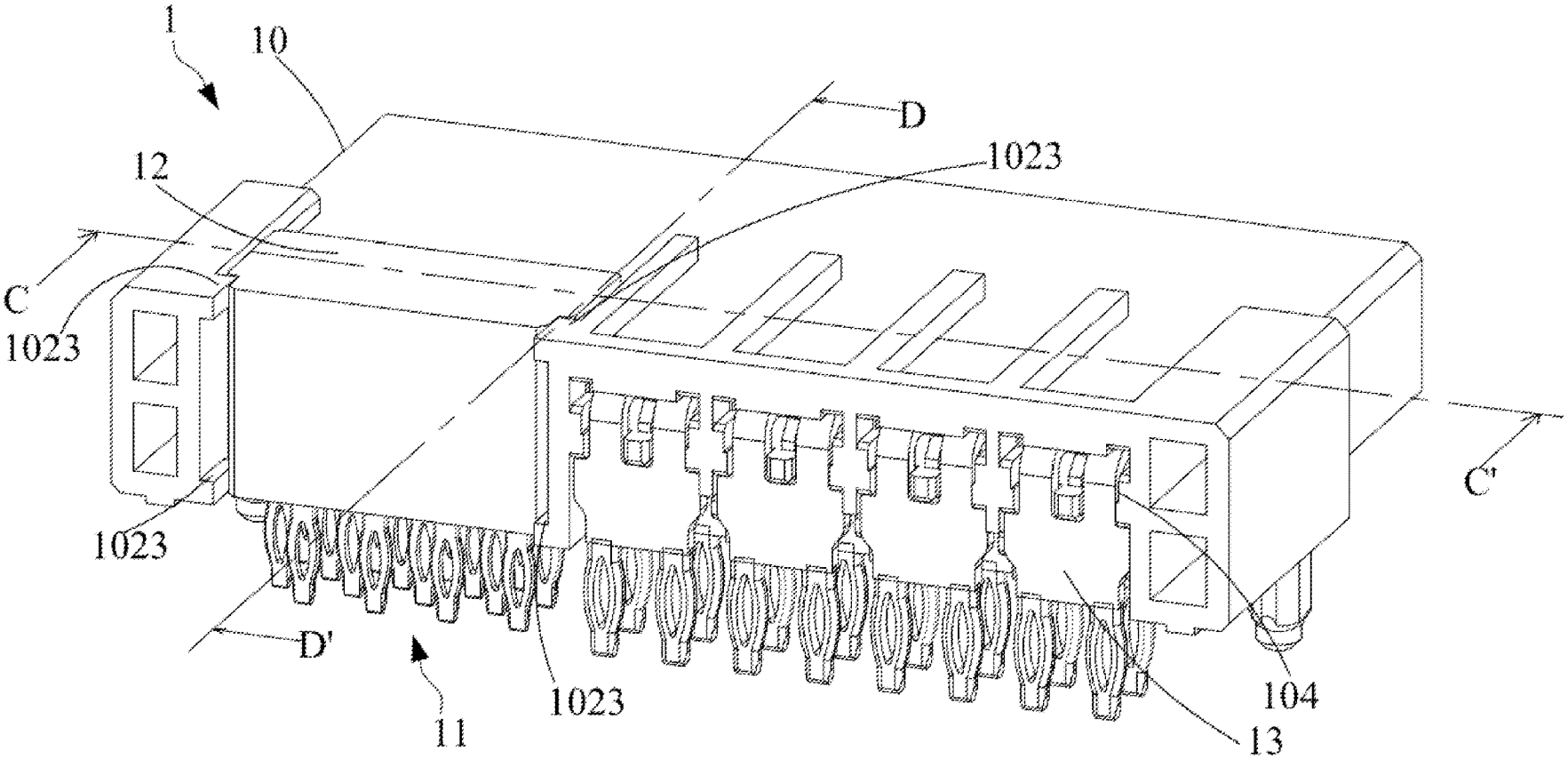
FIG. 2 is another perspective view of an electrical connector of an embodiment of the present disclosure.
Figure 3:
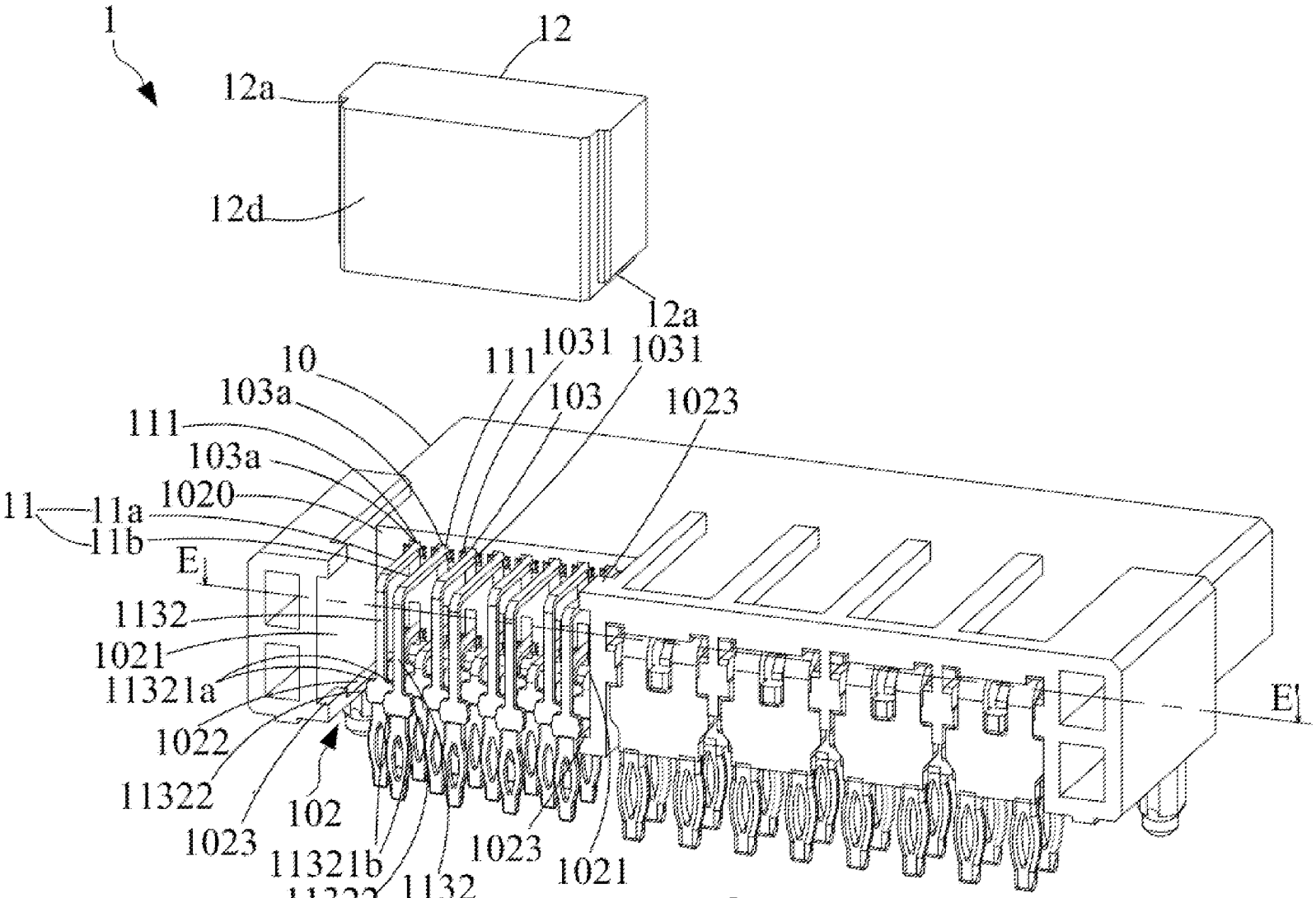
FIG. 3 is an exploded view of an electrical connector of an embodiment of the present disclosure.
Figure 4:
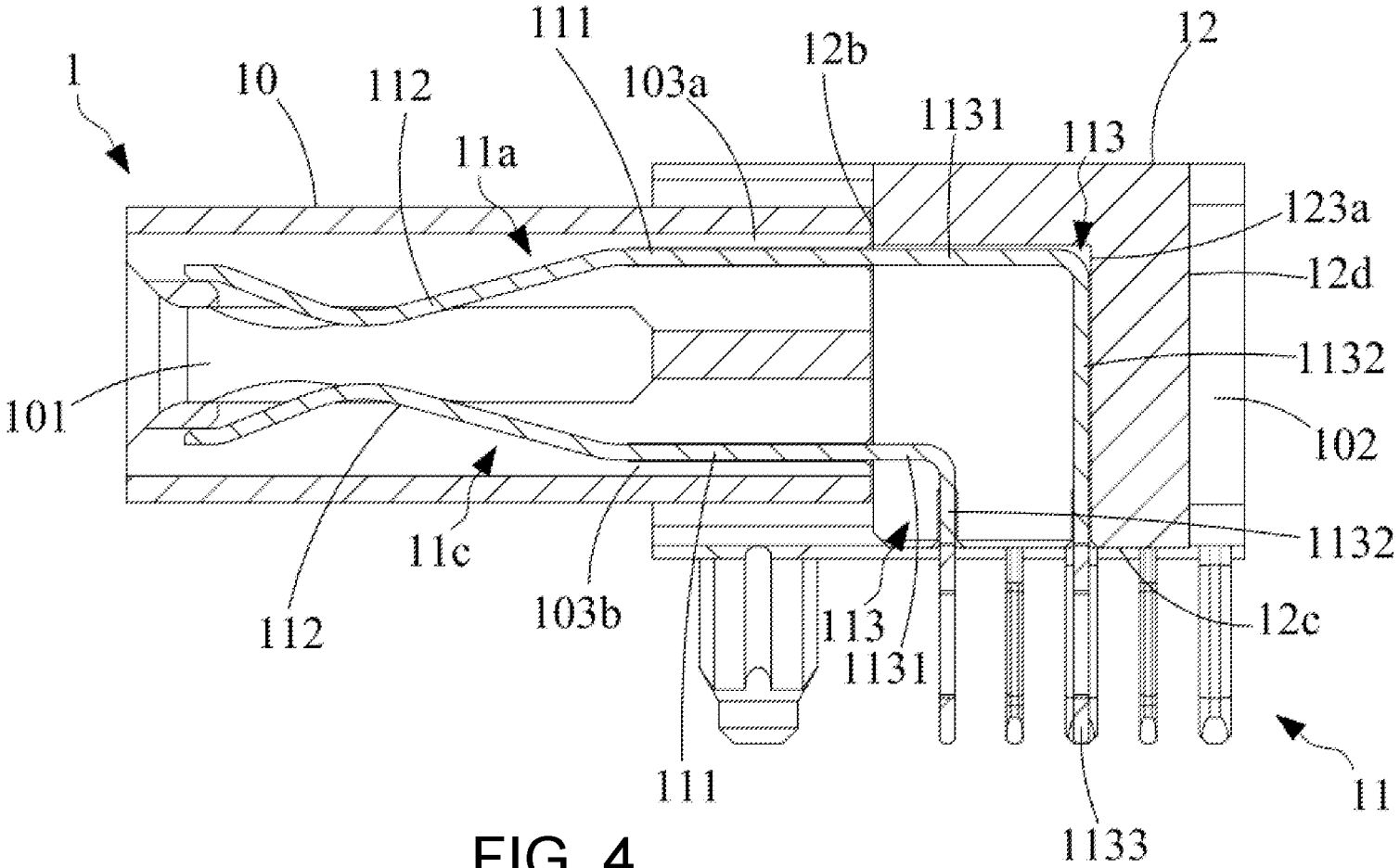
FIG. 4 is a cross-sectional view along line A-A' in FIG. 1.
Figure 5:
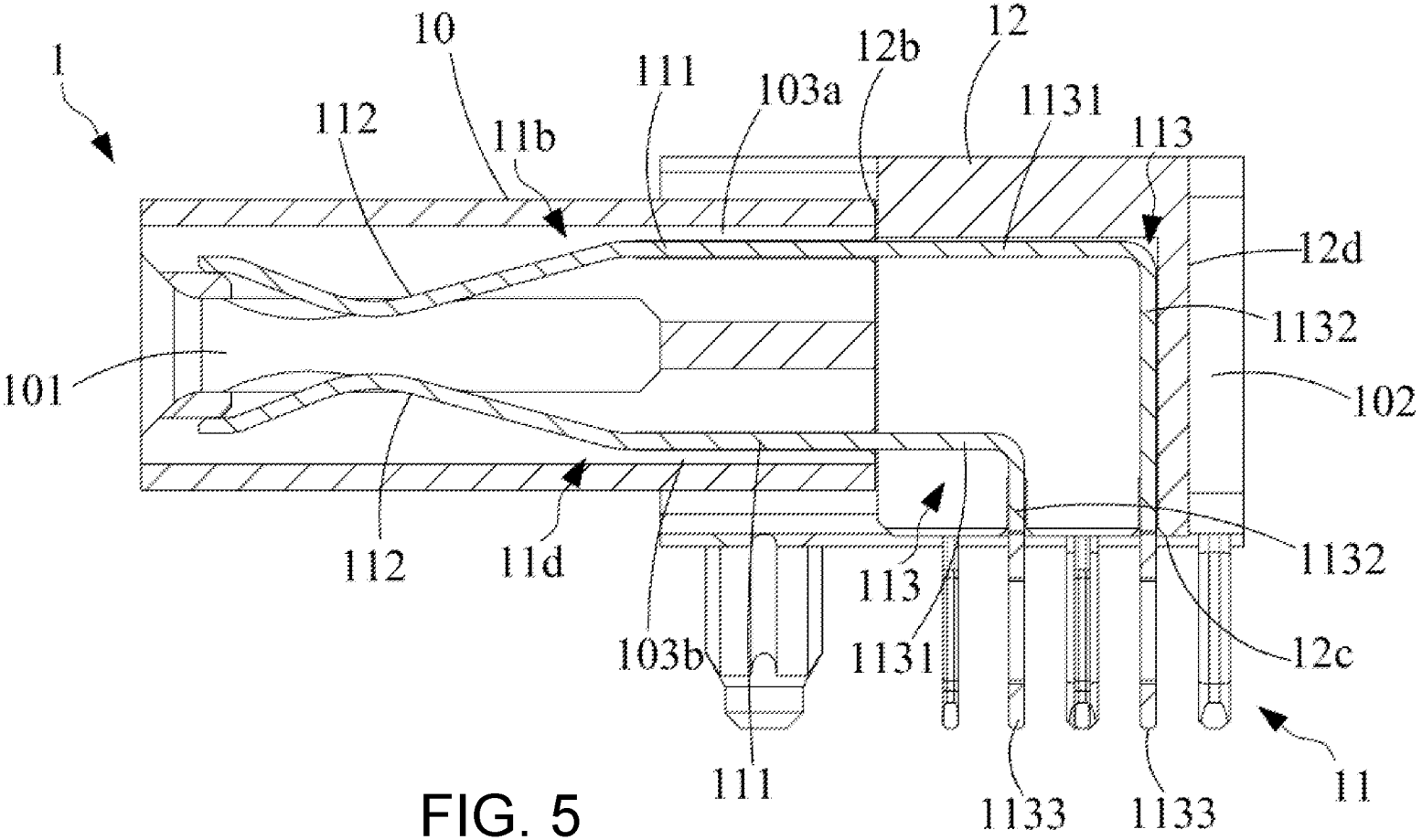
FIG. 5 is a cross-sectional view along line B-B' in FIG. 1.

FIG. 1 and FIG. 2 are perspective views of an electrical connector of an embodiment of the present disclosure. FIG. 3 is an exploded view of an electrical connector of an embodiment of the present disclosure. FIG. 4 is a cross-sectional view along line A-A' in FIG. 1. FIG. 5 is a cross-sectional view along line B-B' in FIG. 1. As shown in the figures, the electrical connector 1 of this embodiment comprises a connector body 10, a plurality of signal terminals 11, and a cover 12. The connector body 10 comprises a plugging slot 101, a cover accommodating notch 102, and a plurality of signal terminal slots 103. The plugging slot 101 is disposed on the front side of the connector body 10. The cover accommodating notch 102 is disposed on the rear side of the connector body 10. The plurality of signal terminal slots 103 is disposed between the plugging slot 101 and the cover accommodating notch 102. The cover accommodating notch 102 communicates with the plugging slot 101 through the plurality of signal terminal slots 103. That is, the plurality of signal terminal slots 103 penetrate the front and rear sides of the connector body 10. The plurality of signal terminal slots 103 is penetrating from the bottom surface of the cover accommodating notch 102 to the bottom surface of the plugging slot 101.

Figure 6:
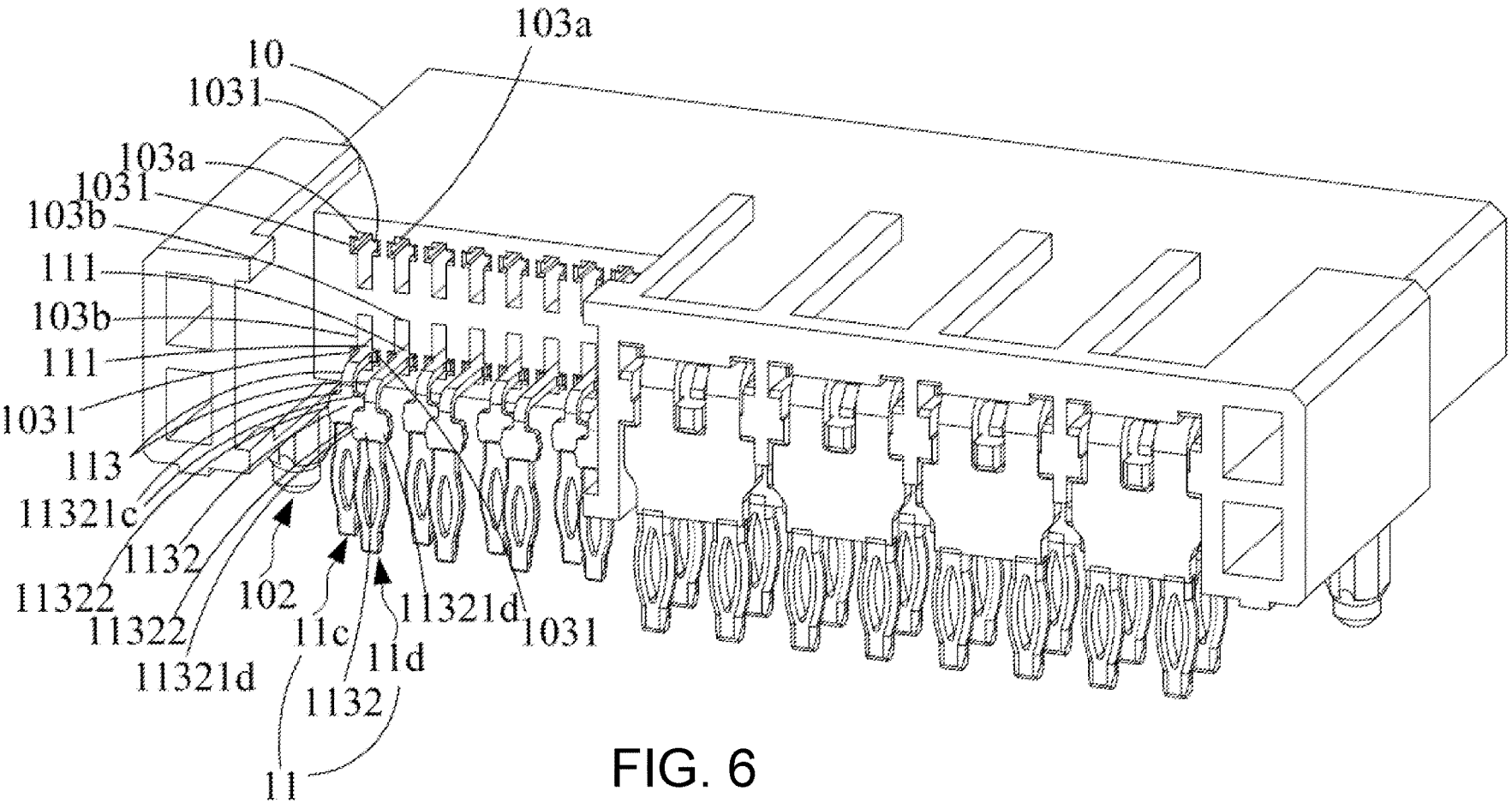
FIG. 6 is a schematic diagram of a connector body provided with a signal terminal of an embodiment of the present disclosure.

FIG. 6 is a schematic diagram of a connector body provided with a signal terminal of an embodiment of the present disclosure. In this embodiment, as shown in the figure, the plurality of signal terminal slots 103 comprises a plurality of first signal terminal slots 103*a* and a plurality of second signal terminal slots 103*b*. The plurality of first signal terminal slots 103*a* are arranged in a row at intervals. The plurality of second signal terminal slots 103*b* are arranged in a row at intervals. The plurality of first signal terminal slots 103*a* are disposed above the plurality of second signal terminal slots 103*b*. The plurality of first signal terminal slots 103*a* are close to an upper surface of the connector body 10. The plurality of second signal terminal slots 103*b* are close to a lower surface of the connector body 10. The plurality of first signal terminal slots 103*a* correspond to the plurality of second signal terminal slots 103*b*. In this way, the plurality of first signal terminal slots 103*a* and the plurality of second signal terminal slots 103*b* would be arranged in a matrix on an end surface 1020 of the cover accommodating notch 102.

The plurality of signal terminals 11 are respectively disposed in the corresponding signal terminal slots 103. In this embodiment, the plurality of signal terminals 11 comprises a plurality of first signal terminals 11*a*, a plurality of second signal terminals 11*b*, a plurality of third signal terminals 11*c*, and a plurality of fourth signal terminals 11*d*. The plurality of first signal terminals 11*a* and the plurality of second signal terminals 11*b* are respectively disposed in the corresponding first signal terminal slots 103*a*, and the plurality of third signal terminals 11*c* and the plurality of fourth signal terminals 11*d* are respectively disposed in the corresponding second signal terminal slots 103*b*. The plurality of first signal terminals 11*a* are disposed above the plurality of third signal terminals 11*c*, and the plurality of second signal terminals 11*b* are disposed above the plurality of fourth signal terminals 11*d*. The plurality of first signal terminals 11*a* and the plurality of second signal terminals 11*b* are arranged alternately, and the plurality of third signal terminals 11*c* and the plurality of fourth signal terminals 11*d* are arranged alternately. The plurality of first signal terminals 11*a* respectively correspond to the plurality of third signal terminals 11*c*. The plurality of second signal terminals 11*b* respectively correspond to the plurality of fourth signal terminals 11*d*.

Figure 7:
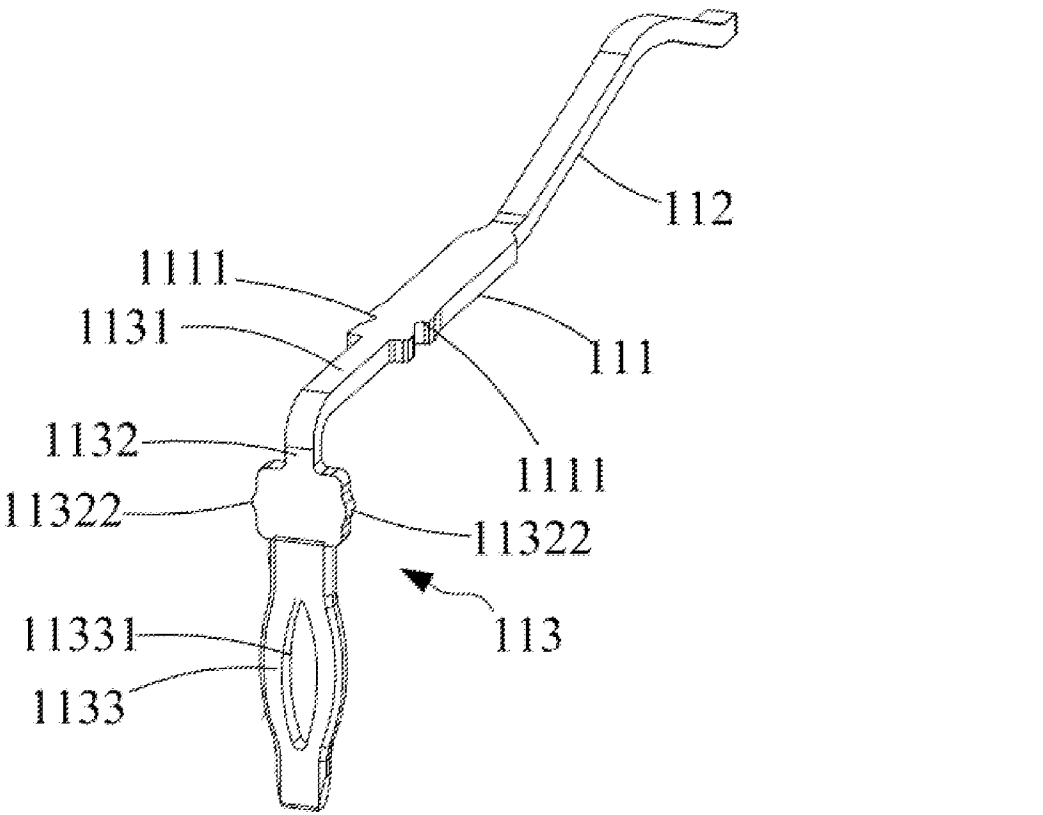
FIG. 7 is a schematic diagram of a signal terminal of an embodiment of the present disclosure.

FIG. 7 is a schematic diagram of a signal terminal of an embodiment of the present disclosure. As shown in the figure, each of the signal terminals 11 comprises a terminal body 111, a plugging end part 112, and a connecting end part 113. The plugging end part 112 and the connecting end part 113 are respectively disposed at two ends of the terminal body 111. When the signal terminal 11 is disposed in the signal terminal slot 103, the terminal body 111 would be disposed in the signal terminal slot 103, the plugging end part 112 would be disposed in the plugging slot 101 and the signal terminal slot 103, a part of the connecting end part 113 would be disposed in the cover accommodating notch 102, and one end of the connecting end part 113 away from the terminal body 111 would protrude from the lower surface of the connector body 10. One end of the connecting end part 113 away from the signal terminal body 111 could also protrude from a rear surface of the connector body 10. In this embodiment, a gap exists between the connecting end part 113 of the first signal terminal 11*a* and the connecting end part 113 of the corresponding third signal terminal 11*c*, and a gap exists between the connecting end part 113 of the second signal terminal 11*b* and the connecting end part 113 of the corresponding fourth signal terminal 11*d*.

Specifically, the connecting end part 113 of each of the signal terminals 11 comprises a first connecting body 1131, a second connecting body 1132, and a connecting pin 1133. One end of the first connecting body 1131 is connected to one end of the terminal body 111 away from the plugging end part 112. One end of the second connecting body 1132 is connected to one end of the first connecting body 1131 away from the terminal body 111. The extending direction of the first connecting body 1131 is parallel to the extending direction of the terminal body 111. The extending direction of the first connecting body 1131 is perpendicular to an end surface 1020 of the cover accommodating notch 102. The extending direction of the second connecting body 1132 is perpendicular to the extending direction of the first connecting body 1131. The extension direction of the second connecting body 1132 is parallel to the end surface 1020 of the cover accommodating notch 102. The connecting pin 1133 is connected to one end of the second connecting body 1132 away from the first connecting body 1131. The connecting pin 1133 extends in a direction same as the extending direction of the second connecting body 1132. Thus, the extending direction of the connecting pin 1133 is parallel to the end surface 1020 of the cover accommodating notch 102. In this way, the connecting end part 113 of each of the signal terminals 11 is bent-shaped. When each of the signal terminals 11 is disposed in the corresponding signal terminal slot 103, the first connecting body 1131 and the second connecting body 1132 would be disposed in the cover accommodating notch 102, and the connecting pin 1133 would be disposed at the outside of the connector body 10. In this embodiment, the connecting pin 1133 is disposed below the lower surface of the connector body 10. The structural configuration of the signal terminal 11 described above is only one embodiment of the present disclosure, and the connecting end part 113 of each of the signal terminals 11 could be linear-shaped. That is, the second connecting body 1132 could be omitted, and the connecting pin 1133 could be directly connected to the first connecting body 1131 and could be disposed at the outside of the rear surface of the connector body 10. In this embodiment, the connecting pin 1133 could comprise a press-fit component 11331 for being press-fitted on the external circuit board. The signal terminal 11 of this embodiment is integrally formed as a one-piece component, which has been purposely divided into multiple parts only for the description of the structural configuration.

Figure 8:
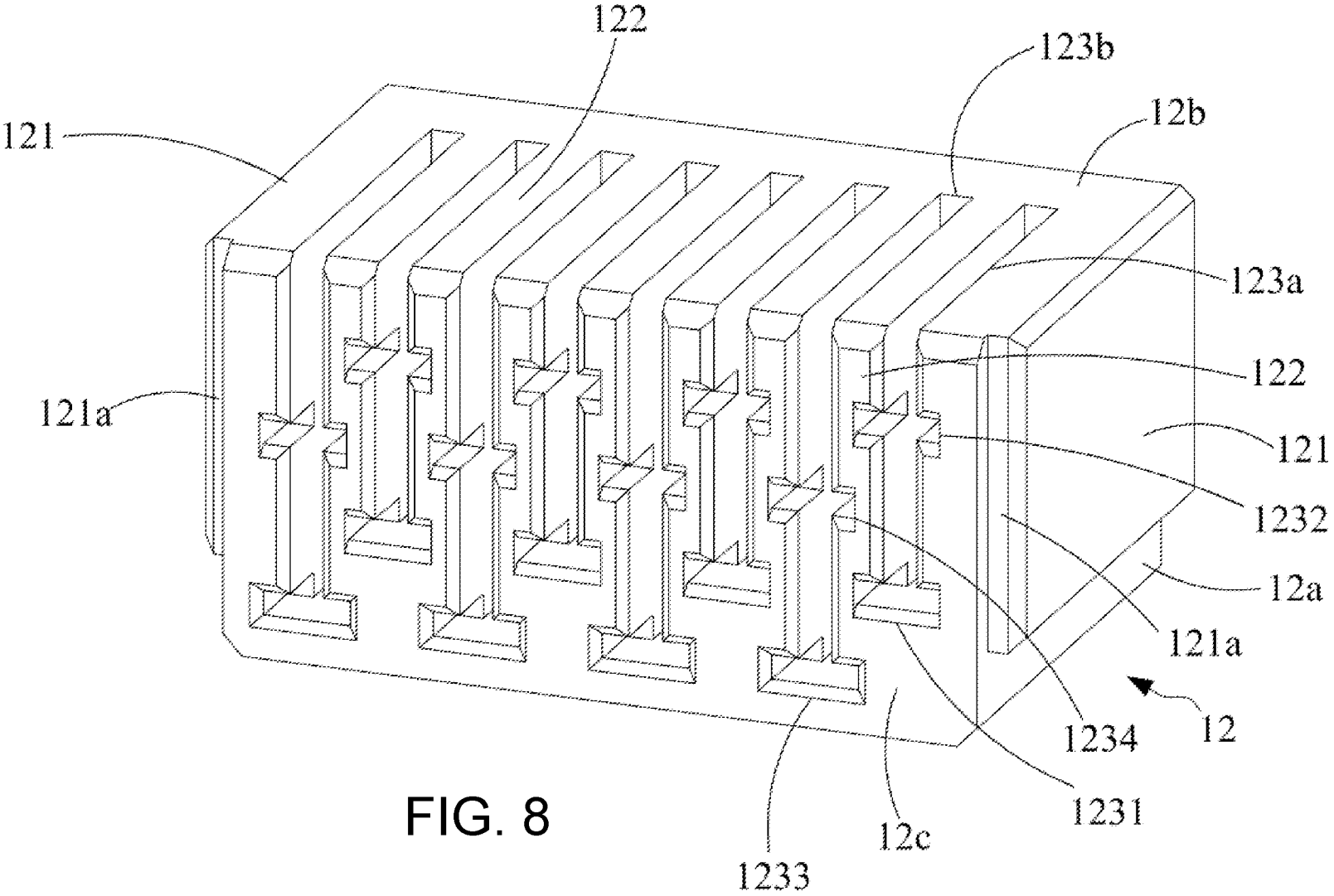
FIG. 8 is a perspective view of a cover of an embodiment of the present disclosure.

The cover 12 is placed into the cover accommodating notch 102 through the upper surface of the connector body 10. The cover body 12 is disposed in the cover body accommodating notch 102 and covers the connecting end parts 113 of the plurality of signal terminals 11 disposed in the cover body accommodating notch 102. FIG. 8 is a perspective view of a cover of an embodiment of the present disclosure. As shown in the figure, the cover 12 of this embodiment comprises two side surfaces 12*a*, a first surface 12*b*, a second surface 12*c*, and a third surface 12*d*. The two side surfaces 12*a* are oppositely disposed. The second surface 12*c* is connected to the first surface 12*b* and the third surface 12*d*. The first surface 12*b*, the second surface 12*c*, and the third surface 12*d* are disposed between the two side surfaces 12*a*. The first surface 12*b* and the third surface 12*d* are oppositely disposed. The second surface 12*c* is perpendicular to the first surface 12*b* and the third surface 12*d*. When the cover 12 is disposed in the cover accommodating notch 102, the two side surfaces 12*a* would correspond to a sidewall of the cover accommodating notch 102, the first surface 12*b* would abut against the end surface 1020 of the cover accommodating notch 102, the second surface 12*c* would correspond to the lower surface of the connector body 10, and the third surface 12*d* would correspond to the rear surface of the connector body 10.

Figure 9:
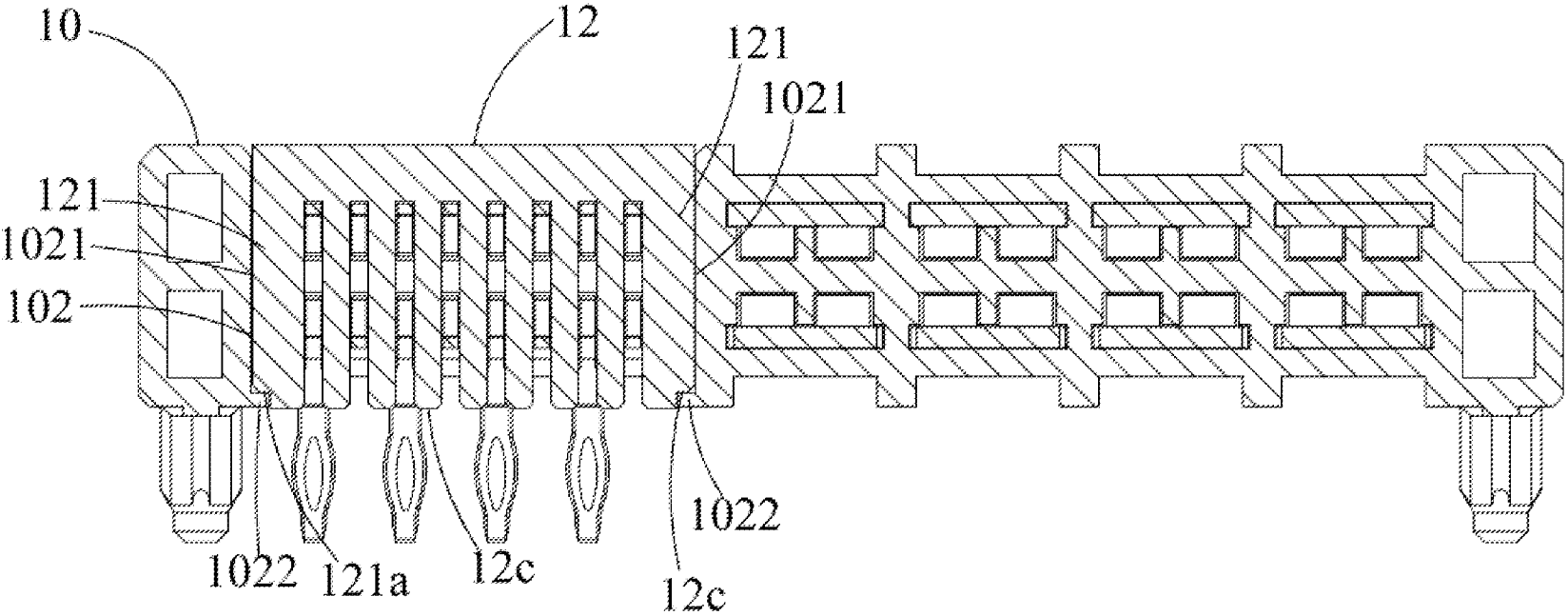
FIG. 9 is a cross-sectional view along line C-C' in FIG. 2.
Figure 10:
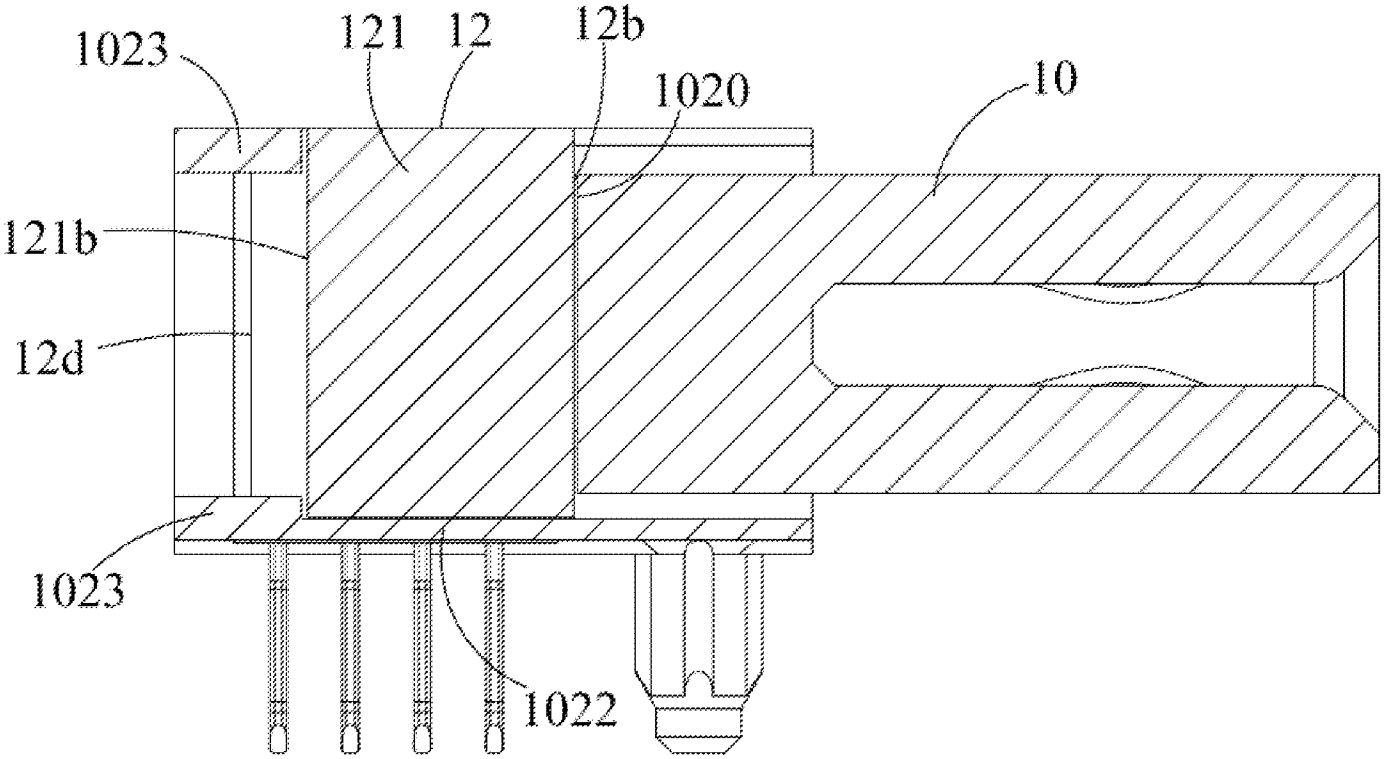
FIG. 10 is a cross-sectional view along line D-D' in FIG. 2.

FIG. 9 is a cross-sectional view along line C-C' in FIG. 2. FIG. 10 is a cross-sectional view along line D-D' in FIG. 2. As shown in the figure, in this embodiment, the cover accommodating notch 102 comprises two sidewalls 1021 oppositely disposed. The cover 12 is restricted by the two sidewalls 1021 only to move between them. An abutting member 1022 is provided on one side of each of the sidewalls 1021 away from an upper surface of the connector body 10 (see FIG. 3). The extension direction of the abutting member 1022 is perpendicular to the end surface 1020 of the cover accommodating notch 102. The two abutting members 1022 are oppositely disposed. The surfaces of the two abutting members 1022 close to an upper surface of the connector body 10 are disposed on the same horizontal plane. The two abutting members 1022 abut against a surface of the cover 12 to support the cover 12 in the cover accommodating notch 102.

In this embodiment, a limiting block 1023 is disposed at one side of each of the sidewalls 1021 of the cover receiving notch 102 away from the bottom surface of the cover accommodating notch 102. The surfaces of the plurality of limiting blocks 1023 close to the end surface 1020 of the cover accommodating notch 102 are vertically disposed on the same plane. The plurality of limit blocks 1023 abut against the surface of the cover 12 to limit the cover 12 to move only in a direction perpendicular to the end surface 1020 of the cover accommodating notch 102. Specifically, the number of the limiting blocks 1023 on each of the sidewalls 1021 of this embodiment is two. One of the two limiting blocks 1023 is disposed on the abutting member 1022, which is close to the lower surface of the body 10. The other limiting block 1023 is close to the upper surface of the body 10. This is only an embodiment of the present disclosure and should not be limited thereto.

Furthermore, in this embodiment, the two side surfaces 12*a* of the cover 12 are respectively provided with a limiting bump 121. Each of the limiting bumps 121 comprises a first limiting surface 121*a* and a second limiting surface 121*b*. The first limiting surface 121*a* is parallel to the second surface 12*c*, and a gap exists between the first limiting surface 121*a* and the second surface 12*c*. The second limiting surface 121*b* is parallel to the third surface 12*d*, and a gap exists between the second limiting surface 121*b* and the third surface 12*d*. When the cover body 12 is disposed in the cover body accommodating notch 102, the two abutting members 1022 abut against the first limiting surface 121*a* of each of the limiting bumps 121 of the cover body 12. That is, each of the abutting members 1022 is disposed in the gap between the first limiting surface 121*a* and the second surface 12*c* to support the cover 12 in the cover accommodating notch 102. In this way, the cover 12 can be prevented from detaching from the lower surface of the connector body 10. Meanwhile, the surfaces of the plurality of limiting blocks 1023 close to the end surface 1020 of the cover accommodating notch 102 abut against the second limiting surface 121*b* of each of the limiting bumps 121 of the cover 12. That is, each of the limiting blocks 1023 is disposed in the gap between the second limiting surface 121*b* and the third surface 12*d* so that the cover 12 is limited to move in a direction perpendicular to the end surface 1020 of the cover accommodating notch 102. In this way, the cover 12 can be prevented from detaching from the rear surface of the connector body 10.

The cover 12 of this embodiment comprises a plurality of signal terminal accommodating grooves disposed at intervals. The plurality of signal terminal accommodating grooves respectively penetrate the first surface 12*b* and the second surface 12*c* of the cover 12. A partition wall 122 is provided between two adjacent signal terminal accommodating grooves of the cover 12. In other words, the two adjacent partition walls 122 are the sidewalls of each of the signal terminal accommodating grooves. When the cover 12 is disposed in the cover accommodating notch 102, the connecting end part 113 of each of the signal terminals 11 disposed in the cover accommodating notch 102 respectively enter the corresponding signal terminal accommodating groove 123. One end of the connecting end part 113 away from the terminal body 111 protrudes from the second surface 12*c* of the cover 12. That is, the first connecting body 1131 and the second connecting body 1132 of the connecting end part 113 are disposed in the signal terminal accommodating groove 123. The connecting pin 1133 protrudes from the second surface 12*c* of the cover 12 and is disposed below the second surface 12*c* of the cover 12.

Figure 11:
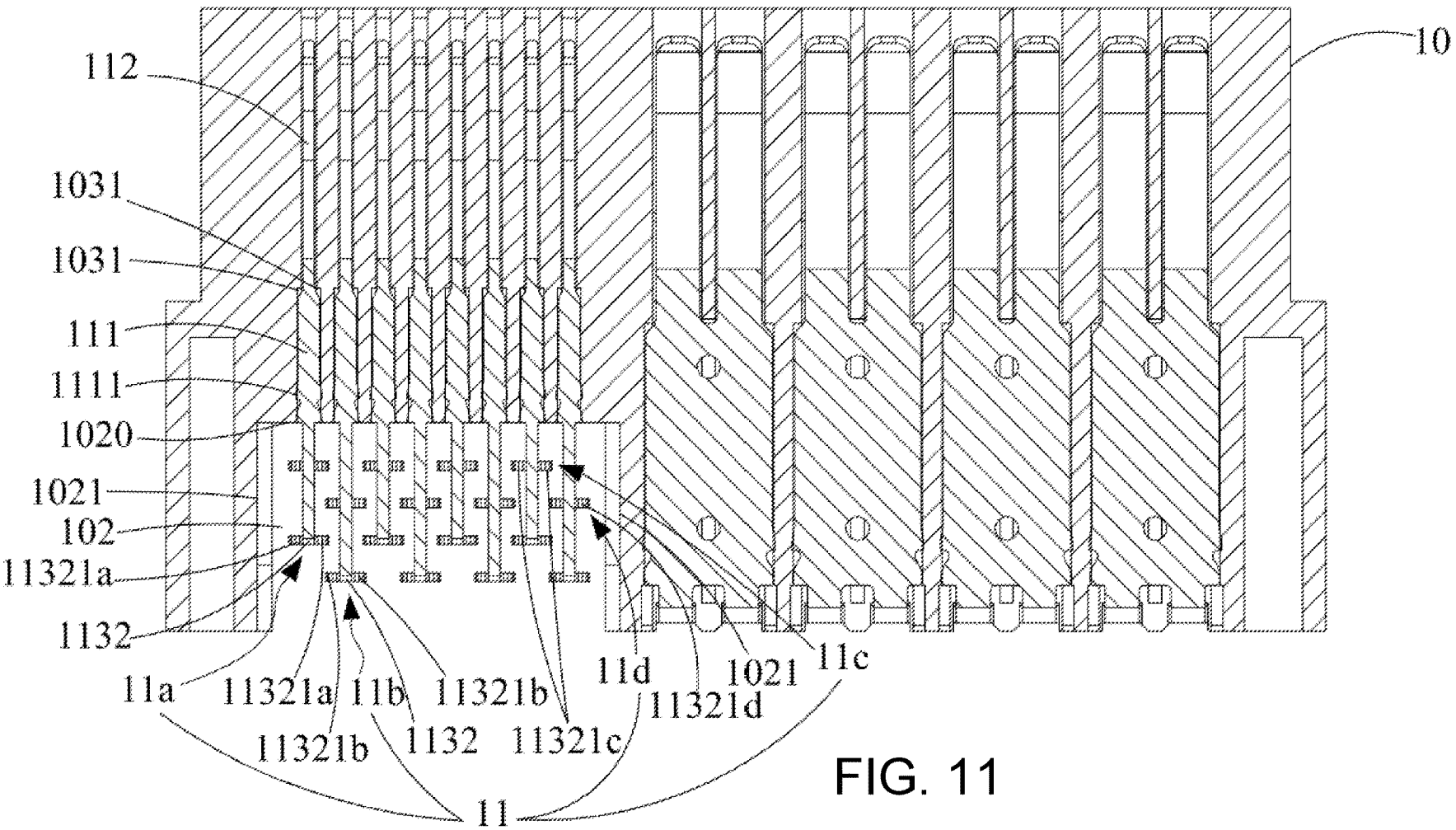
FIG. 11 is a cross-sectional view along line E-E' in FIG. 3.

FIG. 11 is a cross-sectional view along line E-E' in FIG. 3. As shown in the figure, in this embodiment, the two opposite sidewalls of each of the first signal terminal slots 103*a* respectively comprise a positioning groove 1031, and the two opposite sidewalls of each of the second signal terminal slots 103*b* respectively comprise a positioning groove 1031. The extending direction of each of the positioning grooves 1031 is perpendicular to the end surface 1020 of the cover accommodating notch 102. The two positioning grooves 1031 of each of the first signal terminal slots 103*a* are oppositely disposed, and the two positioning grooves 1031 of each of the second signal terminal slots 103*b* are oppositely disposed. The width of the terminal body 111 of each of the signal terminals 11 is wider than the width of the plugging end part 112 of each of the signal terminals 11 and is less than or equal to the distance between the two parallel surfaces of the two positioning grooves 1031 and the sidewall 1021 of the cover accommodating notch 102. When the plurality of signal terminals 11 are respectively disposed in the corresponding first signal terminal slot 103*a* or second signal terminal slot 103*b*, the signal terminal body 111 would be disposed in the two opposite positioning grooves 1031, and the terminal body 111 could only move in a direction perpendicular to the sidewall 1021 of the cover accommodating notch 102 by the restriction of the two surfaces of the two positioning grooves 1031 parallel to the sidewall 1021 of the cover accommodating notch 102. The surfaces of the two positioning grooves 1031 away from the end surface 1020 of the cover accommodating notch 102 block the terminal body 111 to restrict the terminal body 111 from moving toward the plugging slot 101. In this way, the position of the signal terminal 11 in the first signal terminal slot 103*a* or the second signal terminal slot 103*b* can be positioned through the combination of the two positioning grooves 1031 and the terminal body 111. In this embodiment, the terminal body 111 of the first signal terminal 11*a* or the terminal body 111 of the second signal terminal 11*b* is disposed in the two positioning grooves 1031 of the first signal terminal slot 103*a*, and the terminal body 111 of the third signal terminal 11*c* or the terminal body 111 of the fourth signal terminal 11*d* is disposed in the two positioning grooves 1031 of the second signal terminal slot 103*b*.

In one embodiment, the positioning groove 1031 of each of the first signal terminal slots 103*a* is close to the upper surface of the connector body 10, and the positioning groove 1031 of each of the second signal terminal slots 103*b* is close to the lower surface of the connector body 10 (see FIG. 6). When the signal terminal 11 is disposed in the first signal terminal slot 103*a*, the terminal body 111 of the signal terminal 11 would be restricted by the two positioning grooves 1031, the terminal body 111 in the first signal terminal slot 103*a* would be close to the upper surface of the connector body 10, and the plugging end part 112 protruding from the first signal terminal slot 103*a* would be close to the upper surface of the plugging slot 101. In other words, the first signal terminal 11*a* or the second signal terminal 11*b* disposed in the first signal terminal slot 103*a* is close to the upper surface of the connector body 10 (see FIG. 5). Similarly, when the signal terminals 11 are respectively disposed in the second signal terminal slot 103*b*, the terminal body 111 of the signal terminal 11 would be restricted by the two positioning grooves 1031, the terminal body 111 in the second signal terminal slot 103*b* would be close to the lower surface of the connector body 10, and the plugging end part 112 protruding from the second signal terminal slot 103*b* would be close to the lower surface of the plugging slot 101. In other words, the third signal terminal 11*c* or the fourth signal terminal 11*d* disposed in the second signal terminal slot 103*b* is close to the lower surface of the connector body 10 (see FIG. 6).

In one embodiment, two sides of the terminal body 111 are respectively provided with an interfering bump 1111. When the terminal body 111 is disposed in two opposite positioning grooves 1031, the two interfering bumps 1111 of the terminal body 111 interfere with the sidewalls of the two positioning grooves 1031 to secure the terminal body 111 in the two positioning grooves 1031. Thus, the signal terminal 11 can be positioned in the first signal terminal slot 103*a* or the second signal terminal slot 103*b*. For example, two sides of the terminal body 111 of the first signal terminal 11*a* are respectively provided with an interfering bump 1111, and the interfering bump 1111 of the first signal terminal 11*a* interferes with the sidewall of the corresponding positioning groove 1031. Two sides of the terminal body 111 of the second signal terminal 11*b* are respectively provided with an interfering bump 1111, and the interfering bump 1111 of the second signal terminal 11*b* interferes with the sidewall of the corresponding positioning groove 1031. Two sides of the terminal body 111 of the third signal terminal 11*c* are respectively provided with an interfering bump 1111, and the interfering bump 1111 of the third signal terminal 11*c* interferes with the sidewall of the corresponding positioning groove 1031. Two sides of the terminal body 111 of the fourth signal terminal 11*d* are respectively provided with an interfering bump 1111, and the interfering bump 1111 of the fourth signal terminal 11*d* interferes with the sidewall of the corresponding positioning groove 1031.

In one embodiment, the plurality of signal terminal accommodating grooves of the cover 12 comprises a plurality of first signal terminal accommodating grooves 123*a* and a plurality of second signal terminal accommodating grooves 123*b*. The plurality of first signal terminal accommodating grooves 123*a* and the plurality of second signal terminal accommodating grooves 123*b* are disposed alternately. That is, the second signal terminal accommodating groove 123*b* is disposed between two adjacent first signal terminal accommodating grooves 123*a*. The plurality of connecting end parts 113 of the plurality of first signal terminals 11*a* and the plurality of connecting end parts 113 of the plurality of third signal terminals 11*c* are respectively disposed in the plurality of first signal terminal accommodating grooves 123*a*. Each of the first signal terminal accommodating grooves 123*a* accommodates the first connecting body 1131 and the second connecting body 1132 of the first signal terminal 11*a* and the first connecting body 1131 and the second connecting body 1132 of the third signal terminal 11*c* corresponding to the first signal terminal 11*a* (see FIG. 4). The plurality of connecting end parts 113 of the plurality of second signal terminals 11*b* and the plurality of connecting end parts 113 of the plurality of fourth signal terminals 11*d* are respectively disposed in the plurality of second signal terminal accommodating grooves 123*b*. Each of the second signal terminal accommodating grooves 123*b* accommodates the first connecting body 1131 and the second connecting body 1132 of the second signal terminal 11*b* and the first connecting body 1131 and the second connecting body 1132 of the fourth signal terminal 11*d* corresponding to the second signal terminal 11*b* (see FIG. 5). In other words, the cover 12 covers the first connecting body 1131 and the second connecting body 1132 of the connecting end part 113 of each of the signal terminals 11.

In one embodiment, two sides of the second connecting body 1132 of the first signal terminal 11*a* are respectively provided with a first positioning bump 11321*a*. The two first positioning bumps 11321*a* are oppositely disposed. Similarly, two sides of the second connecting body 1132 of the second signal terminal 11*b* are respectively provided with a second positioning bump 11321*b*. The two second positioning bumps 11321*b* are oppositely disposed. Two sides of the second connecting body 1132 of the third signal terminal 11*c* are respectively provided with a third positioning bump 11321*c*. The two third positioning bumps 11321*c* are oppositely disposed. Similarly, two sides of the second connecting body 1132 of the fourth signal terminal 11*d* are respectively provided with a fourth positioning bump 11321*d*. The two fourth positioning bumps 11321*d* are oppositely disposed.

Since a gap exists between the connecting end part 113 of the first signal terminal 11*a* in the first signal terminal slot 103*a* and the connecting end part 113 of the third signal terminal 11*c* in the second signal terminal slot 103*b*, the two first positioning bumps 11321*a* are farther than the two third positioning bumps 11321*c* away from the end surface 1020 of the cover accommodating notch 102. Since a gap exists between the connecting end part 113 of the second signal terminal 11*b* in the first signal terminal slot 103*a* and the connecting end part 113 of the fourth signal terminal 11*d* in the second signal terminal slot 103*b*, the two second positioning bumps 11321*b* are farther than the two fourth positioning bumps 11321*d* away from the end surface 1020 of the cover accommodating notch 102.

Figure 12:
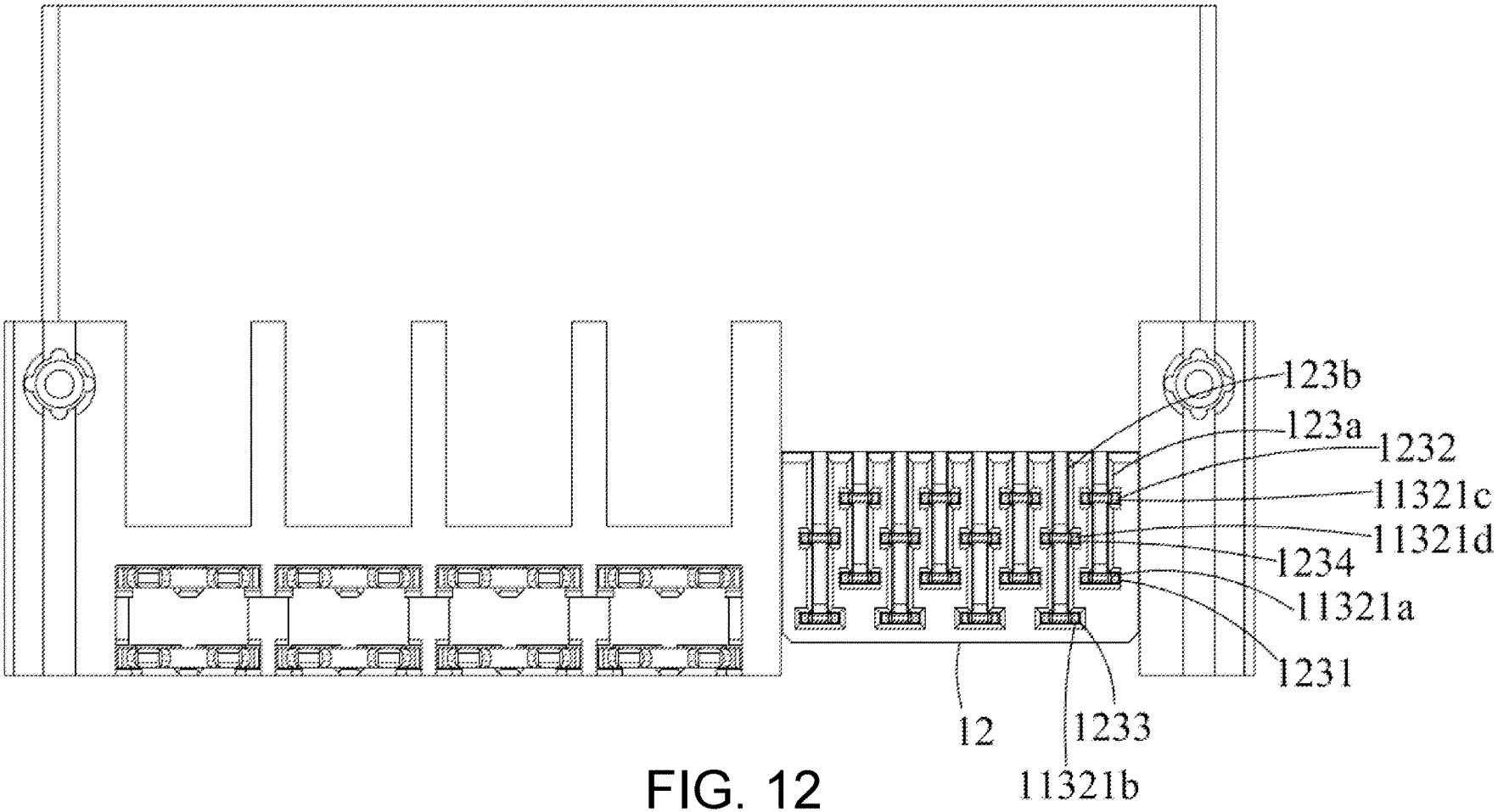
FIG. 12 is a bottom view of an electrical connector of an embodiment of the present disclosure.

FIG. 12 is a bottom view of an electrical connector of an embodiment of the present disclosure. As shown in the figure, in one embodiment, the two opposite partition walls 122 in each of the first signal terminal accommodating grooves 123*a* are respectively provided with a first positioning groove 1231 and a second positioning groove 1232. The two first positioning grooves 1231 and the two second positioning grooves 1232 penetrate the second surface 12*c* of the cover 12. That is, the extending direction of the first positioning groove 1231 and the extending direction of the second positioning groove 1232 are perpendicular to the second surface 12*c* of the cover 12. The two first positioning grooves 1231 are oppositely disposed, and the two second positioning grooves 1232 are oppositely disposed. The two first positioning grooves 1231 are farther away than the two second positioning grooves 1232 from the first surface 12*b* of the cover 12. The two first positioning bumps 11321*a* of the first signal terminal 11*a* in the first signal terminal accommodating groove 123*a* are disposed in the two first positioning grooves 1231, and the two third positioning bumps 11321*c* of the third signal terminal 11*c* in the first signal terminal accommodating groove 123*a* are disposed in the two second positioning grooves 1232.

Similarly, the two opposite partition walls 122 in each of the second signal terminal accommodating grooves 123*b* are respectively provided with a third positioning groove 1233 and a fourth positioning groove 1234. The two third positioning grooves 1233 and the two fourth positioning grooves 1234 penetrate the second surface 12*c* of the cover 12. That is, the extending direction of the third positioning groove 1233 and the extending direction of the fourth positioning groove 1234 are perpendicular to the second surface 12*c* of the cover 12. The two third positioning grooves 1233 are oppositely disposed, and the two fourth positioning grooves 1234 are oppositely disposed. The two third positioning grooves 1233 are farther away than the two fourth positioning grooves 1234 from the first surface 12*b* of the cover 12. The two second positioning bumps 11321*b* of the second signal terminal 11*b* in the second signal terminal accommodating groove 123*b* are disposed in the two third positioning grooves 1233, and the two fourth positioning bumps 11321*d* of the fourth signal terminal 11*d* in the second signal terminal accommodating groove 123*b* are disposed in the two fourth positioning grooves 1234.

When the two first positioning bumps 11321*a* enter the two first positioning grooves 1231, the surface of each of the first positioning grooves 1231 away from the second surface 12*c* blocks each of the first positioning bumps 11321*a* from moving into the first signal terminal accommodating groove 123*a* to position the connecting end part 113 of the first signal terminal 11*a* in the first signal terminal accommodating groove 123*a*. Similarly, when the two third positioning bumps 11321*c* enter the two second positioning grooves 1232, the surface of each of the second positioning grooves 1232 away from the second surface 12*c* blocks each of the first positioning bumps 11321*a* from moving into the first signal terminal accommodating groove 123*a* to position the connecting end part 113 of the third signal terminal 11*c* in the first signal terminal accommodating groove 123*a*.

When the two second positioning bumps 11321*b* enter the two third positioning grooves 1233, the surface of each of the third positioning grooves 1233 away from the second surface 12*c* blocks the each of the second positioning bumps 11321*b* from moving into the second signal terminal accommodating groove 123*b* to position the connecting end part 113 of the second signal terminal 11*b* in the second signal terminal accommodating groove 123*b*. Similarly, when the two fourth positioning bumps 11321*d* enter the two fourth positioning grooves 1234, the surface of each of the fourth positioning grooves 1234 away from the second surface 12*c* blocks each of the fourth positioning bumps 11321*d* from moving into the second signal terminal accommodating groove 123*b* to position the connecting end part 113 of the third signal terminal 11*c* in the second signal terminal accommodating groove 123*b*.

In one embodiment, the two positioning bumps of the second connecting body 1132 of each of the signal terminals 11 comprise a first interfering bump 11322, respectively. That is, the first positioning bump 11321*a*, the second positioning bump 11321*b*, the third positioning bump 11321*c*, and the fourth positioning bump 11321*d* all comprise a first interfering bump 11322. When the two positioning bumps of each of the signal terminals 11 are disposed in the corresponding positioning groove, the first interfering bump 11322 of each of the positioning bumps interferes with the sidewall of the corresponding positioning groove to secure the two positioning bumps in the corresponding positioning grooves. Thus, the connecting end part 113 of each of the signal terminals 11 can be fixed in the corresponding signal terminal accommodating groove. For example, the first interfering bump 11322 of the first positioning bump 11321*a* interferes with the sidewall of the first positioning groove 1231, the first interfering bump 11322 of the second positioning bump 11321*b* interferes with the sidewall of the third positioning groove 1233, the first interfering bump 11322 of the third positioning bump 11321*c* interferes with the sidewall of the second positioning groove 1232, and the first interfering bump 11322 of the fourth positioning bump 11321*d* interferes with the sidewall of the fourth positioning groove 1234.

In one embodiment, the length of the first connecting body 1131 of the second signal terminal 11*b* protruding from the end surface 1020 of the cover accommodating notch 102 is greater than the length of the first signal terminal 11*a* protruding from the end surface 1020 of the cover accommodating notch 102. The distance between the surface of the second signal terminal accommodating groove 123*b* parallel to the first surface 12*b* and the first surface 12*b* is greater than the distance between the surface of the first signal terminal accommodating groove 123*a* parallel to the first surface 12*b* and the first surface 12*b*. The distance between the surface of the second signal terminal accommodating groove 123*b* parallel to the first surface 12*b* of the cover 12 and the first surface 12*b* of the cover 12 is greater than the distance between the surface of the first signal terminal accommodating groove 123*a* parallel to the first surface 12*b* of the cover 12 and the first surface 12*b* of the cover 12. In this way, the first signal terminal accommodating groove 123*a* accommodates the first signal terminal 11*a* and the third signal terminal 11*c*, and the second signal terminal accommodating groove 123*b* accommodates the second signal terminal 11*b* and the fourth signal terminal 11*d*.

The two fourth positioning bumps 11321*d* of the fourth signal terminal 11*d* are farther than the two third positioning bumps 11321*c* of the third signal terminal 11*c* away from the end surface 1020 of the cover accommodating notch 102. The two first positioning bumps 11321*a* of the first signal terminal 11*a* are farther than the two fourth positioning bumps 11321*d* of the fourth signal terminal 11*d* away from the end surface 1020 of the cover accommodating notch 102. The two second positioning bumps 11321*b* of the second signal terminal 11*b* are farther than the two first positioning bumps 11321*a* of the first signal terminal 11*a* away from the end surface 1020 of the cover accommodating notch 102. That is, the third positioning bump 11321*c*, the fourth positioning bump 11321*d*, the first positioning bump 11321*a*, and the second positioning bump 11321*b* are arranged in the above order in a direction toward the cover accommodating notch 102 from the end surface 1020 of the cover accommodating notch 102 at intervals.

The two third positioning grooves 1233 of the second signal terminal accommodating groove 123*b* are farther than the two second positioning grooves 1232 of the first signal terminal accommodating groove 123*a* away from the first surface 12*b* of the cover 12. The two first positioning grooves 1231 of the first signal terminal accommodating groove 123*a* are farther than the two third positioning grooves 1233 of the second signal terminal accommodating groove 123*b* away from the first surface 12*b* of the cover 12. The two fourth positioning grooves 1234 of the second signal terminal accommodating groove 123*b* are farther than the two first positioning grooves 1231 of the first signal terminal accommodating groove 123*a* away from the first surface 12*b* of the cover 12. The second positioning groove 1232, the fourth positioning groove 1234, the first positioning groove 1231, and the third positioning groove 1233 are disposed on the partition wall 122 in the above order in a direction toward the third surface 12*d* from the first surface 12*b* at intervals. That is, the first positioning groove 1231, the second positioning groove 1232, the third positioning groove 1233, and the fourth positioning groove 1234 on each of the partition walls 122 are alternately arranged. Thus, the width of each of the partition walls 122 can be reduced to be slightly greater than or equal to the width of the signal terminal accommodating groove. In this embodiment, the width of each of the partition walls 122 is smaller than twice the length of a positioning groove (such as the first positioning groove 1231). The length of the positioning groove refers to a distance between the surface of the signal terminal accommodating groove and the bottom surface of the positioning groove. When the width of each of the partition walls 122 is slightly greater than or equal to the width of the signal terminal accommodating groove, it is necessary to reduce the difference between the width of each of the partition walls 122 and the width of the signal terminal accommodating groove to prevent the partition wall 122 from being deformed (such as size reduction) when the cover 12 is under the process of molding. Therefore, the cover 12 would be molded in uniform and would not be deformed.

The connector body 10 of this embodiment further comprises a plurality of power terminal slots 104. The plurality of power terminal slots 104 extend from the rear side of the connector body 10 to the front side and communicate with the plugging slot 101. In this embodiment, the electrical connector 1 further comprises a plurality of power terminals 13 respectively disposed in the corresponding power terminal slots 104.

In summary, embodiments of the present disclosure provide an electrical connector. The cover is fixed in the cover accommodating notch through the abutting member and the limiting block disposed in the cover body accommodating notch to prevent the cover from detaching from the cover accommodating notch when the electrical connector is in use. Thus, the cover could cover a plurality of signal terminals stably to avoid exposure of the signal terminals.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a connector body comprising a plugging slot, a cover accommodating notch and a plurality of signal terminal slots, the plurality of the signal terminal slots being disposed between the plugging slot and the cover accommodating notch, the cover accommodating notch communicating with the plugging slot through the signal terminal slot, the cover accommodating notch comprising two opposite sidewalls, an abutting member being disposed on a side of the sidewall, a limiting block being disposed at one end of each of the sidewalls away from an end surface of the cover accommodating notch;

a plurality of signal terminals respectively disposed in the corresponding signal terminal slots; and a cover disposed in the cover accommodating notch, covering the plurality of the signal terminals, the two abutting members supporting the cover, the two limiting blocks restricting the cover to allow the cover moving in a direction perpendicular to the end surface of the cover accommodating notch;

wherein, the cover comprises two side surfaces, the two side surfaces correspond to the two sidewalls respectively, each of the side surfaces comprises a limiting bump, each of the limiting bumps comprises a first limiting surface and a second limiting surface, the two abutting members abut against the two first limiting surfaces of the limiting bump; the limiting block abuts against the second limiting surface of the limiting bump.

2. The electrical connector according to claim 1, wherein the cover comprises a first surface, a second surface and a third surface; the first surface, the second surface, and the third surface are disposed between the two side surfaces; the first surface is opposite to the third surface; the first surface abuts against the end surface of the cover accommodating notch; the second surface corresponds to a lower surface of the connector body; the first limiting surface is parallel to the second surface; a gap exists between the first limiting surface and the second surface; the second limiting surface is parallel to the third surface; a gap exists between the second limiting surface and the third surface.

3. The electrical connector according to claim 1, wherein each of the signal terminals comprises a terminal body, a plugging end part, and a connecting end part; the plugging end part and the connecting end part are respectively disposed at two ends of the terminal body; the terminal body is disposed in the corresponding signal terminal slot; the plugging end part is disposed in the plugging slot; the connecting end part is disposed in the cover accommodating notch; one end of the connecting end part away from the terminal body protrudes from the cover.

4. The electrical connector according to claim 3, wherein the connecting end part of each of the signal terminals comprises a first connecting body, a second connecting body, and a connecting pin; one end of the first connecting body is connected to one end of the terminal body away from the plugging end part; one end of the second connecting body is connected to one end of the first connecting body away from the terminal body; the connecting pin is connected to one end of the second connecting body away from the first connecting body; the extending direction of the first connecting body is perpendicular to the end surface of the cover accommodating notch; the extending direction of the second connecting body and the connecting pin is parallel to the end surface of the cover accommodating notch; the cover covers the first connecting body and the second connecting body; the connecting pin protrudes from the cover.

5. The electrical connector according to claim 4, wherein the connecting pin comprises a press-fit component.

6. The electrical connector according to claim 1, wherein the plurality of signal terminal slots comprises a plurality of first signal terminal slots and a plurality of second signal terminal slots; the plurality of first signal terminal slots are disposed in a row at intervals; the plurality of second signal terminal slots are disposed in a row at intervals; the plurality of first signal terminal slots are disposed above the plurality of second signal terminal slots; the plurality of first signal terminal slots correspond to the plurality of second signal terminal slots; the plurality of the signal terminals are respectively disposed in the corresponding first signal terminal slot or the second signal terminal slot.

7. The electrical connector according to claim 6, wherein the plurality of signal terminals comprises a plurality of first signal terminals, a plurality of second signal terminals, a plurality of third signal terminals, and a plurality of fourth signal terminals; the plurality of first signal terminals and the plurality of second signal terminals are respectively disposed in the plurality of first signal terminal slots; the plurality of first signal terminals and the plurality of second signal terminals are alternately arranged; the plurality of third signal terminals and the plurality of fourth signal terminals are respectively disposed in the plurality of second signal terminal slots; the plurality of third signal terminals and the plurality of fourth signal terminals are alternately arranged; the plurality of first signal terminals correspond to the plurality of third signal terminals; the plurality of second signal terminals correspond to the plurality of fourth signal terminals; each of the first signal terminals, each of the second signal terminals, each of the third signal terminals, and each of the fourth signal terminals respectively comprises a terminal body, a plugging end part and a connecting end part; each of the connecting end parts comprises a first connecting body, a second connecting body, and a connecting pin.

8. The electrical connector according to claim 7, wherein the cover comprises a first surface, a second surface, a third surface, a plurality of first signal terminal accommodating grooves, a plurality of second signal terminal accommodating grooves, and a plurality of partition walls; the second surface is disposed between the first surface and the third surface; the plurality of first signal terminal accommodating grooves and the plurality of second signal terminal accommodating grooves are respectively disposed at intervals as they are alternately arranged; the plurality of the partition walls are respectively disposed between the first signal terminal accommodating groove and the second signal terminal accommodating groove adjacent to the first signal terminal accommodating groove; the plurality of first signal terminal accommodating grooves and the plurality of second signal terminal accommodating grooves penetrate the first surface and the second surface; each of the first signal terminal accommodating grooves accommodates the first connecting body and the second connecting body of the first signal terminal and the first connecting body and the second connecting body of the third signal terminal; each of the second signal terminal accommodating grooves accommodates the first connecting body and the second connecting body of the second signal terminal and the first connecting body and the second connecting body of the fourth signal terminal.

9. The electrical connector according to claim 8, wherein a gap exists between the connecting end part of the first signal terminal and the connecting end part of the third signal terminal; a gap exists between the connecting end part of the second signal terminal and the connecting end part of the fourth signal terminal.

10. The electrical connector according to claim 9, wherein two sides of the second connecting body of the first signal terminal are respectively provided with a first positioning bump; the two first positioning bumps are oppositely disposed; two sides of the second connecting body of the second signal terminal are respectively provided with a second positioning bump; the two second positioning bumps are oppositely disposed; two sides of the third connecting body of the third signal terminal are respectively provided with a third positioning bump; the two third positioning bumps are oppositely disposed; two sides of the fourth connecting body of the fourth signal terminal are respectively provided with a fourth positioning bump; the two fourth positioning bumps are oppositely disposed; the two partition walls of the first signal terminal accommodating groove respectively comprise a first positioning groove and a second positioning groove; the two first positioning grooves are oppositely disposed; the two partition walls of the second signal terminal accommodating groove opposite to the two second positioning grooves respectively comprise two opposite third positioning grooves and two opposite fourth positioning grooves; the two first positioning bumps are disposed in the two first positioning grooves; the two third positioning bumps are disposed in the two second positioning grooves; the two second positioning bumps are disposed in the two third positioning grooves; the two fourth positioning bumps are disposed in the two fourth positioning grooves; the two first positioning bumps are farther than the two third positioning bumps away from the end surface of the cover accommodating notch; the two first positioning grooves are farther than the two second positioning grooves away from the first surface; the two second positioning bumps are farther than the two fourth positioning bumps away from the end surface of the cover accommodating notch; the two third positioning grooves are farther than the two fourth positioning grooves away from the first surface.

11. The electrical connector according to claim 10, wherein the first positioning bump, the second positioning bump, the third positioning bump, and the fourth positioning bump respectively comprise a first interfering bump; the first interfering bump of the first positioning bump interferes with a sidewall of the first positioning groove; the first interfering bump of the second positioning bump interferes with a sidewall of the third positioning groove; the first interfering bump of the third positioning bump interferes with a sidewall of the second positioning groove; the first interfering bump of the fourth positioning bump interferes with a sidewall of the fourth positioning groove.

12. The electrical connector according to claim 10, wherein the distance between a surface of the second signal terminal accommodating groove parallel to the first surface and the first surface is greater than the distance between a surface of the first signal terminal accommodating groove parallel to the first surface and the first surface; the length of the first connecting body of the second signal terminal protruding from the end surface of the cover accommodating notch is greater than the length of the first connecting body of the first signal terminal.

13. The electrical connector according to claim 12, wherein the third positioning bump, the fourth positioning bump, the first positioning bump, and the second positioning bump are arranged toward the cover accommodating notch from the end surface of the cover accommodating notch at intervals; the second positioning groove, the fourth positioning groove, the first positioning groove, and the third positioning groove are disposed on the partition wall in a direction toward the third surface from the first surface at intervals.

14. The electrical connector according to claim 13, wherein the thickness of the partition wall is thinner than twice the length of the first positioning groove.

15. The electrical connector according to claim 7, wherein two opposite sidewalls of the first signal terminal slot are respectively provided with a positioning groove; the two positioning grooves of the first signal terminal slot are oppositely disposed; two opposite sidewalls of the second signal terminal slot are respectively provided with a positioning groove; the two positioning grooves of the second signal terminal slot are oppositely disposed; the terminal body of the first signal terminal or the terminal body of the second signal terminal are disposed in the two positioning grooves of the first signal terminal slot; the terminal body of the third signal terminal or the terminal body of the fourth signal terminal are disposed in the two positioning grooves of the second signal terminal slot.

16. The electrical connector according to claim 15, wherein the two positioning grooves of the first signal terminal slot are close to an upper surface of the connector body; the two positioning grooves of the second signal terminal slot are close to a lower surface of the connector body.

17. The electrical connector according to claim 16, wherein two sides of the terminal body of the first signal terminal are respectively provided with an interfering bump; the interfering bump of the first signal terminal interferes with a sidewall of the corresponding positioning groove; two sides of the terminal body of the second signal terminal are respectively provided with an interfering bump; the interfering bump of the second signal terminal interferes with a sidewall of the corresponding positioning groove; two sides of the terminal body of the third signal terminal are respectively provided with an interfering bump; the interfering bump of the third signal terminal interferes with a sidewall of the corresponding positioning groove; two sides of the terminal body of the fourth signal terminal are respectively provided with an interfering bump; the interfering bump of the fourth signal terminal interferes with a sidewall of the corresponding positioning groove.

* * * * *